United States Patent [19]

Ushio et al.

[11] 4,447,306

[45] May 8, 1984

[54] PLATING APPARATUS

[75] Inventors: Tetsuji Ushio, Fukuoka; Satoru Tatsuguchi, Chiba; Toshihisa Otani, Fukuoka; Hoshiro Tani, Fukuoka; Tetsuo Yabe, Fukuoka, all of Japan

[73] Assignee: Mishima Kosan Corporation, Fukuoka, Japan

[21] Appl. No.: 340,908

[22] Filed: Jan. 20, 1982

[30] Foreign Application Priority Data

Jan. 28, 1981 [JP] Japan ..... 56-012033

[51] Int. Cl.[3] ..... C25D 17/02; C25D 17/06

[52] U.S. Cl. ..... 204/224 R; 204/225; 204/297 R

[58] Field of Search ..... 204/224 R, 297 R, 225; 118/406, 429

[56] References Cited

U.S. PATENT DOCUMENTS

| | | | |
|---|---|---|---|
| 1,771,680 | 7/1930 | Ishisaka | 204/224 R |
| 2,135,873 | 11/1938 | Jones et al. | 204/224 R |
| 4,069,121 | 1/1978 | Baud et al. | 204/224 R X |
| 4,081,347 | 3/1978 | Becker | 204/224 R |
| 4,290,867 | 9/1981 | Jumer | 204/297 R X |

*Primary Examiner*—Donald R. Valentine

*Attorney, Agent, or Firm*—Jordan and Hamburg

[57] ABSTRACT

Apparatus is provided for plating a portion of an object. The apparatus has a cut out section in one of its side walls. Engagement is maintained between the object and the cut out edges, through a sealing means and adjustable set screw means. This forms a liquid-tight tank in which is disposed an anode and plating liquid. The anode is electrically connected for plating on the object.

6 Claims, 5 Drawing Figures

PLATING APPARATUS

BACKGROUND OF THE INVENTION

This invention relates to an apparatus for plating a portion of a large-sized structure.

Heretofore, when it was desired to plate a part of a large-sized structure, it was necessary to apply a non-plating treatment such as a resinous material or tapes to the part of the object which was not to be plated. In addition, it was necessary to place the entire object into the plating liquid. This arrangement resulted in a reduction of the plating quality and also resulted in deterioration of the soluble impurities and the like adhering to the structure.

Accordingly, an object of the present invention is to overcome the disadvantages of known prior art arrangements and to provide a plating apparatus which permits plating of one part of an object without exposing the other parts thereof to the plating liquid. The above object is accomplished by utilizing a plating tank having a cutout section in one of the side walls, the cutout section having a lower edge and two side edges, the lower edge providing a support holder for supporting the object in a position within the cutout section. A top plate is disposed on top of the object and extends between the two side edges of the cutout section. Sealing means are disposed along the two side edges and along the supporting holder for providing a seal between the tank and the object and between the tank and the top plate. The sealing means also extends between the top plate and the object to provide a seal therebetween. A base on which the tank is disposed mounts an upright support and first adjustable set screw means are provided on the upright support and are operable to engage the object and to move the object horizontally toward the tank. Second adjustable set screw means are mounted on the tank and operable to engage the top plate to move the top plate horizontally toward the tank. In addition, third adjustable set screw means are mounted on the tank and operable to engage the top plate and move the latter vertically downwardly toward the object, whereby the first, second and third set screw means in cooperation with the seal means are operable to effect a liquid-tight seal such that plating liquid in the tank is utilized in conjunction with plating at least a portion of one side of the object which is disposed in the cutout section.

DESCRIPTION OF THE PREFERRED EMBODIMENTS

Figure 4:
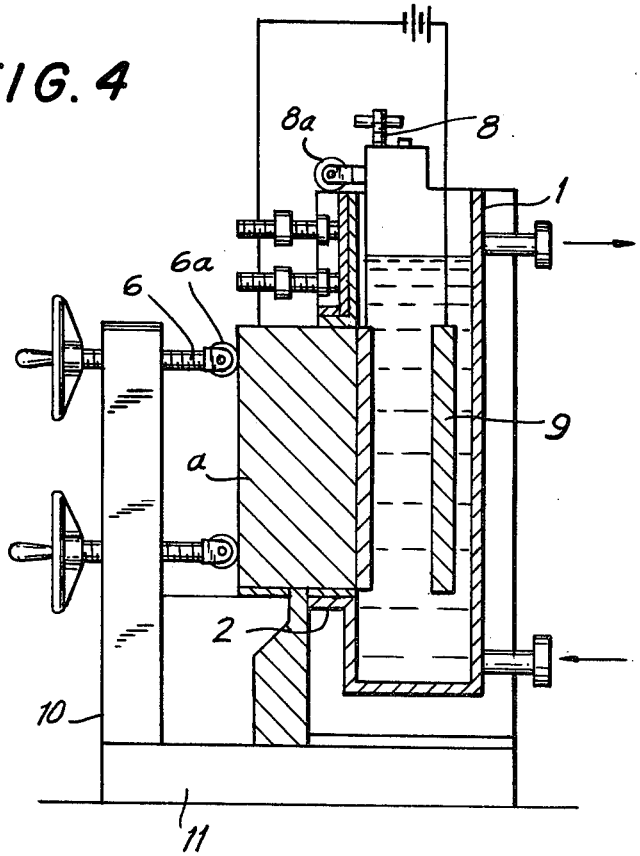
FIG. 4 is a cross-sectional view of the apparatus.
Figure 2:
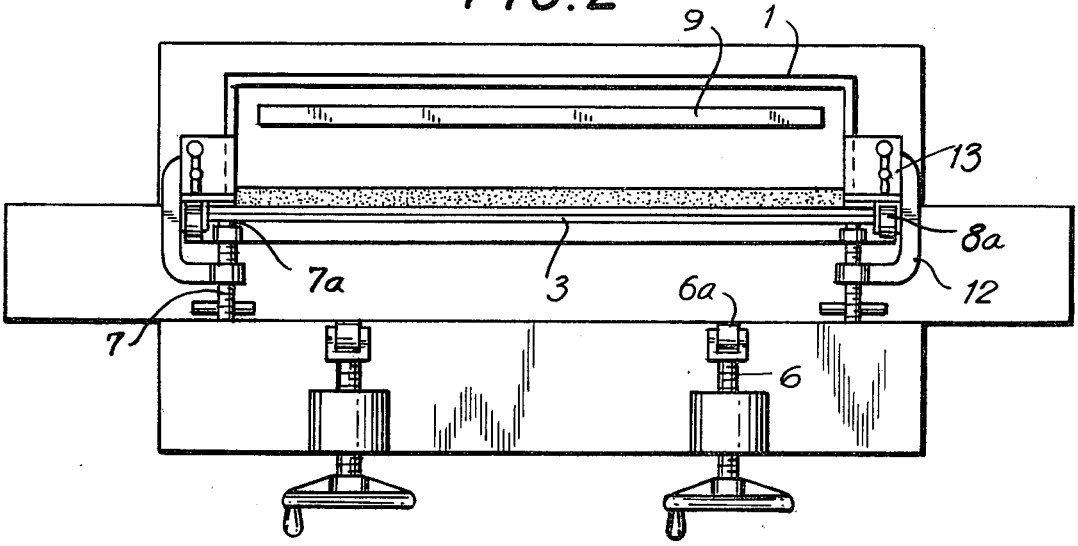
FIG. 2 is a top plan view of an apparatus according to the present invention.
Figure 3:
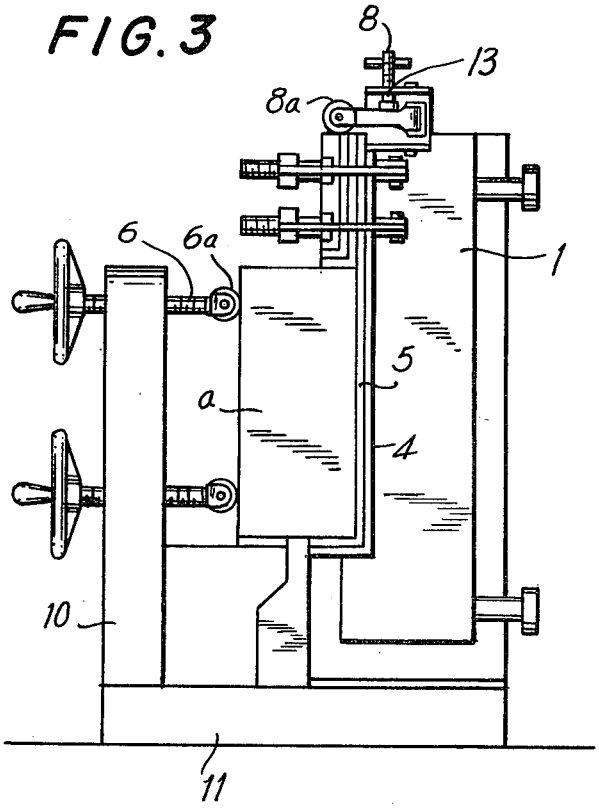
FIG. 3 is a right side view of the apparatus shown in FIG. 2.
Figure 5:
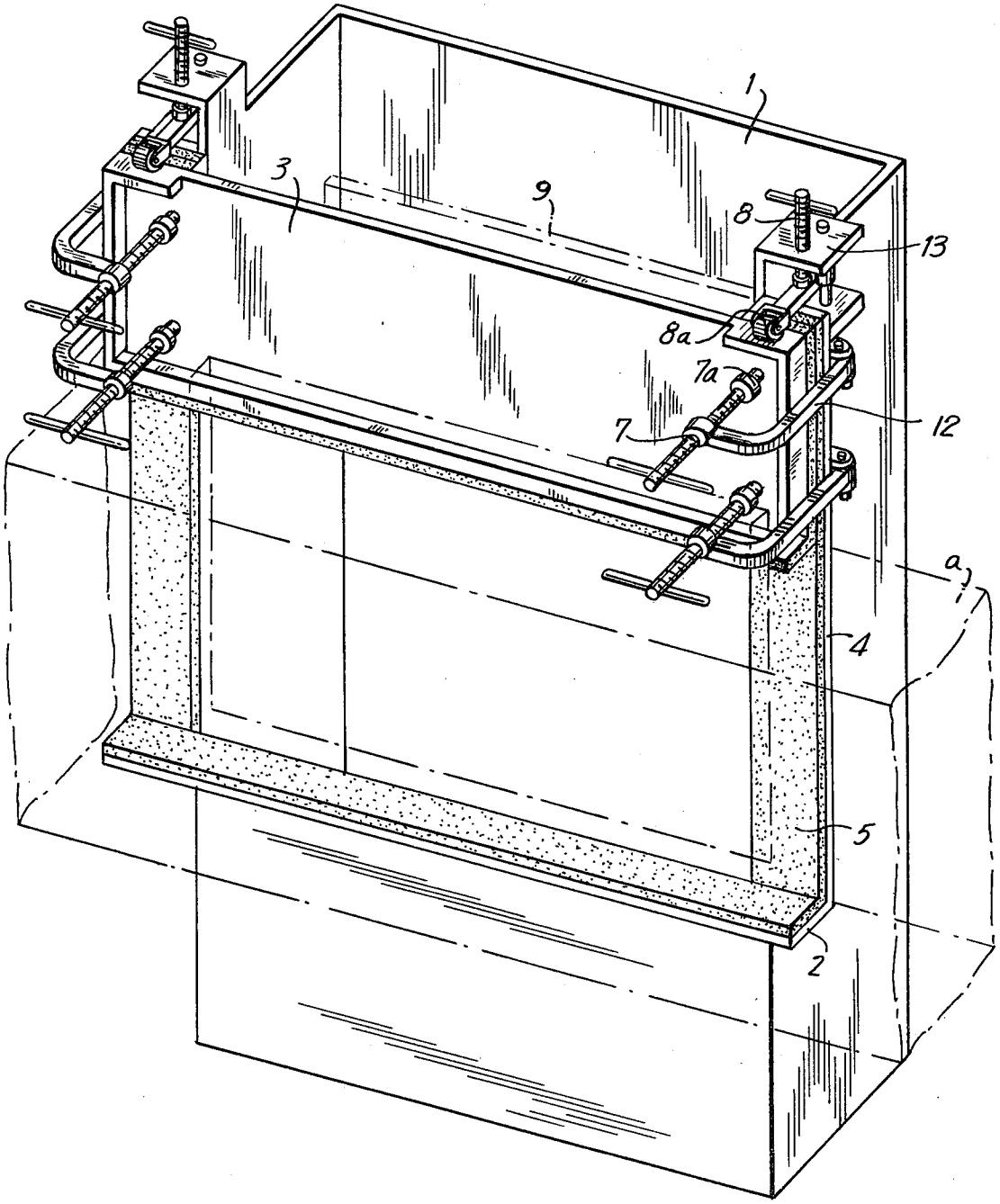
FIG. 5 is a partial perspective view of the apparatus.

A plating apparatus of the present invention is described with reference to FIGS. 2 to 5. The apparatus shown in FIGS. 2 to 5 includes a structure formed as a main plating tank 1 having four side walls and a bottom. One of the side walls of the plating tank 1 is cut out, the cutout extending a certain distance from the bottom of the tank as shown in FIG. 4, for example. The bottom of the cutout has a supporting holder 2 for receiving the object to be plated, hereinafter referred to as plating object a. A flat part 4 (best shown in FIG. 5) extends along the sides of the cutout part.

A top plate 3 is disposed in the cutout part over the plating object a. A packing forming a seal 5 is disposed between the top of the plating object a and the bottom of the top plate 3, between the lower side of the plating object a and the upper side of the supporting holder 2, and between the plating object a and the flat part 4. The aforementioned seal 5 is perhaps best shown in FIG. 5.

The plating object a is disposed on the supporting holder 2 and is supported by adjustable set screws 6 each having a roller 6*a* on the longitudinal end thereof. The set screws 6 are mounted on an upright support 10 extending upwardly from a base 11 on which the tank 1 is disposed.

Horizontal adjustable set screws 7 are provided for the top plate 3. The set screws 7 are mounted on brackets 12 extending from the tank 1.

Vertical adjustable set screws 8 are also provided for the top plate 3. These set screws 8 are mounted on a bracket 13 on the tank 1 and engage an arm having a roller 8*a* mounted thereon.

From the above-described arrangement as shown in the drawings, it will be seen that the adjustable set screws provide for a liquid-tight seal between the main tank 1 and the object and top plate. It will be seen that minor regulation or adjustment is possible by adjusting the set screws as the rollers on the end thereof roll on the object or the top plate.

The adjustable set screw 7 is also provided with means 7*a* on the end thereof which may consist of a roller or a universal joint.

Figure 1:
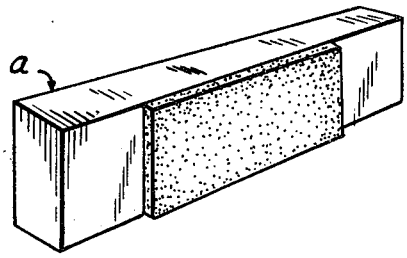
FIG. 1 is a perspective view of a structure which has been plated on one part thereof by the apparatus of the present invention.

With the above arrangement, an anode 9 is disposed in the plating tank and the electrical connection is provided as illustrated in applicants' FIG. 4. Thus it will be seen from the above that it is possible to plate only a part of the plating object a, that is the part or side thereof exposed to the plating liquid in the tank 1, such part which is plated being indicated by the speckled portion in FIG. 1. It will be further seen that the portions of the plating object which are not to be plated are not subjected to exposure to the plating liquid.

What we claim is:

1. Plating apparatus for plating a portion of an object, comprising a plating tank having a bottom and side walls extending upwardly from said bottom, an anode disposed in said plating tank and electrically connected to said object, one of said side walls having a cutout section, said cutout section having a lower edge and two side edges, a supporting holder along said lower edge for supporting said object in a position juxtaposed to said cutout section, a top plate disposed on top of said object and extending between said two side edges of said cutout section, sealing means along said two side edges and along said supporting holder for providing a seal between said tank and said object and between said tank and said top plate, said sealing means also extending between said top plate and said object to provide a seal between said top plate and said object, a base on which said tank is disposed, an upright support extending from said base, first adjustable set screw means on said upright support operable to engage said object and to move said object horizontally toward said tank, a second adjustable set screw means mounted in said tank and operable to engage said top plate and to move said top plate horizontally toward said tank, and third adjustable set screw means mounted on said tank and operable to engage said top plate and move the latter vertically downwardly toward said object, whereby said first, second and third set screw means in cooperation with said seal means are operable to effect a liquid-tight seal such that plating liquid in said tank is utilized in conjunction with said anode in plating at least a portion on one side of said object which is disposed in said cutout section.

2. Plating apparatus according to claim 1, wherein said first and second adjustable set screw means each comprise longitudinally extending threaded elements having the axes thereof horizontally disposed, said third adjustable set screw means comprising longitudinally extending threaded elements having the axes thereof vertically disposed.

3. Plating apparatus according to claim 2, wherein said first adjustable set screw means comprises rollers mounted on the ends of the respective longitudinally extending threaded elements, said rollers engaging a side of said object.

4. Plating apparatus according to claim 3, wherein said third adjustable set screw means comprises rollers mounted on the ends of the respective longitudinally extending threaded elements, said rollers engaging the top of said top plate.

5. Plating apparatus according to claim 2, wherein said second adjustable set screw means comprises clamping elements having at an L-shaped configuration and extending at least partially outwardly of the sides of said top plate.

6. Plating apparatus according to claim 2, wherein said supporting holder comprises a horizontal surface, said sealing means being disposed on said horizontal surface, said two side edges of said cutout section being defined by vertically disposed flat surfaces, said sealing means being disposed along said vertically disposed flat surfaces.

* * * * *